US009078075B2

(12) United States Patent
Shennib et al.

(10) Patent No.: US 9,078,075 B2
(45) Date of Patent: Jul. 7, 2015

(54) TOOL FOR INSERTION OF CANAL HEARING DEVICE INTO THE EAR CANAL

(71) Applicant: IHEAR MEDICAL, INC., San Leandro, CA (US)

(72) Inventors: Adnan Shennib, Oakland, CA (US); Victor Valenzuela, Hayward, CA (US); Patrick Contioso, Sunnyvale, CA (US)

(73) Assignee: iHear Medical, Inc., San Leandro, CA (US)

( * ) Notice: Subject to any disclaimer, the term of this patent is extended or adjusted under 35 U.S.C. 154(b) by 299 days.

(21) Appl. No.: 13/691,641

(22) Filed: Nov. 30, 2012

(65) Prior Publication Data

US 2014/0150234 A1 Jun. 5, 2014

(51) Int. Cl.
*B25B 27/00* (2006.01)
*H04R 25/00* (2006.01)

(52) U.S. Cl.
CPC ..... *H04R 25/60* (2013.01); *Y10T 29/53943* (2015.01); *Y10T 29/49826* (2015.01); *H04R 2460/17* (2013.01)

(58) Field of Classification Search
CPC ..... B23P 11/00; H04R 25/60; H04R 25/65; H04R 25/658; H04R 2460/17; H04R 2225/023; Y10T 29/53; Y10T 29/537; Y10T 29/53796; Y10T 29/53909; Y10T 29/53943; Y10T 29/49826
See application file for complete search history.

(56) References Cited

U.S. PATENT DOCUMENTS 5,327,500 A 7/1994 Campbell
5,553,152 A 9/1996 Newton
5,645,074 A 7/1997 Shennib et al.
5,659,621 A 8/1997 Newton
5,701,348 A 12/1997 Shennib et al.
5,785,661 A 7/1998 Shennib et al.
6,137,889 A 10/2000 Shennib et al.
6,212,283 B1 4/2001 Fletcher et al.
6,359,993 B2 3/2002 Brimhall
6,367,578 B1 4/2002 Shoemaker
6,382,346 B2 5/2002 Brimhall et al.
6,473,513 B1 10/2002 Shennib et al.
6,546,108 B1 4/2003 Shennib et al.
6,724,902 B1 4/2004 Shennib et al.

(Continued)

FOREIGN PATENT DOCUMENTS

WO 99/07182 2/1999
WO 99/07182 A2 2/1999

OTHER PUBLICATIONS

International Search Report and Written Opinion dated Nov. 3, 2010 for PCT Appl. No. US2010/048299.

(Continued)

*Primary Examiner* — Alexander P Taousakis
(74) *Attorney, Agent, or Firm* — Dorsey & Whitney LLP

(57) ABSTRACT

A hand held tool for safely inserting a canal hearing device into the ear canal having a medial end configured to simultaneously cradle the lateral end of the canal hearing device and constrain a knob element laterally positioned on the canal hearing device. In a preferred embodiment, the insertion tool comprises a C-shaped cavity for self-centering engagement with a D-shaped lateral end of a CIC device, providing ease of use for hearing impaired individuals. In a preferred embodiment, the insertion tool is substantially formed of a single monolithic structure for improved durability and lower cost of fabrication.

34 Claims, 6 Drawing Sheets

(56) References Cited

U.S. PATENT DOCUMENTS

| | | | | |
|---|---|---|---|---|
| 6,937,735 | B2 | 8/2005 | DeRoo et al. | |
| 6,940,988 | B1 | 9/2005 | Shennib et al. | |
| 7,016,511 | B1 | 3/2006 | Shennib | |
| 7,113,611 | B2 | 9/2006 | Leedom et al. | |
| 7,215,789 | B2 | 5/2007 | Shennib et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,321,663 | B2 | 1/2008 | Olsen | |
| 7,403,629 | B1 | 7/2008 | Aceti et al. | |
| 7,424,123 | B2 | 9/2008 | Shennib et al. | |
| 7,424,124 | B2 | 9/2008 | Shennib et al. | |
| 7,580,537 | B2 | 8/2009 | Urso et al. | |
| 7,664,282 | B2 | 2/2010 | Urso et al. | |
| 8,155,361 | B2 | 4/2012 | Schindler | |
| 8,184,842 | B2 | 5/2012 | Howard et al. | |
| 8,467,556 | B2 | 6/2013 | Shennib et al. | |
| 8,571,247 | B1 * | 10/2013 | Oezer | 381/329 |
| 2001/0008560 | A1 | 7/2001 | Stonikas et al. | |
| 2002/0027996 | A1 | 3/2002 | Leedom et al. | |
| 2002/0085728 | A1 | 7/2002 | Shennib et al. | |
| 2005/0249370 | A1 | 11/2005 | Shennib et al. | |
| 2005/0259840 | A1 | 11/2005 | Gable et al. | |
| 2005/0283263 | A1 | 12/2005 | Eaton et al. | |
| 2006/0291683 | A1 | 12/2006 | Urso et al. | |
| 2007/0071265 | A1 | 3/2007 | Leedom et al. | |
| 2010/0040250 | A1 | 2/2010 | Gebert | |
| 2010/0119094 | A1 | 5/2010 | Sjursen et al. | |
| 2010/0239112 | A1 | 9/2010 | Howard et al. | |
| 2011/0058697 | A1 | 3/2011 | Shennib et al. | |
| 2011/0188689 | A1 | 8/2011 | Beck et al. | |
| 2011/0206225 | A1 * | 8/2011 | Moller et al. | 381/314 |
| 2012/0285470 | A9 | 11/2012 | Sather et al. | |
| 2013/0010406 | A1 | 1/2013 | Stanley | |
| 2013/0223666 | A1 * | 8/2013 | Michel et al. | 381/329 |
| 2013/0243229 | A1 | 9/2013 | Shennib et al. | |
| 2013/0294631 | A1 | 11/2013 | Shennib et al. | |
| 2014/0153761 | A1 | 6/2014 | Shennib et al. | |
| 2014/0153762 | A1 | 6/2014 | Shennib et al. | |

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.

"User Manual—2011", AMP Personal Audio Amplifiers, 2011.

* cited by examiner

TOOL FOR INSERTION OF CANAL HEARING DEVICE INTO THE EAR CANAL

TECHNICAL FIELD

Examples described herein relate to hearing devices, and particularly hearing devices that are positioned in the ear canal for inconspicuous wear. This application is related to pending patent application Ser. No. 12/878,926, titled CANAL HEARING DEVICE WITH DISPOSABLE BATTERY MODULE, Ser. No. 13/424,242, titled BATTERY MODULE FOR PERPENDICULAR DOCKING INTO A CANAL HEARING DEVICE, and Ser. No. 13/461,327, titled TOOL FOR REMOVAL OF CANAL HEARING DEVICE FROM EAR CANAL, incorporated herein in their entirety by this reference for any purpose.

BACKGROUND

The ear canal 10, as illustrated in FIG. 1, is generally narrow and tortuous, and is approximately 26 millimeters (mm) long from the canal aperture 11 to the tympanic membrane (eardrum) 15. The lateral part 12 is referred to as the cartilaginous canal due to the underlying cartilaginous tissue 16. The medial part, proximal to the tympanic membrane, is rigid and referred to as the bony region 13 due to the underlying bone tissue. The dimensions and contours of the ear canal may vary significantly among individuals. There is a characteristic "S" shape with a first and second bends generally occurring at the aperture area 11, and bony-cartilaginous junction area 8, respectively. "Medial" and "lateral" are relative terms used throughout to describe position, towards or away-from the eardrum, respectively. The concha cavity 5, although outside the ear canal 10, is generally hidden from frontal viewing by the tragus 3.

Placement of a canal hearing device 20 inside the concha region 5 and the ear canal 10 can be challenging due to difficulty in access and manipulation of a miniature canal device, particularly when placed substantially inside the ear canal 10. However, it is generally desirable to place a hearing device inside the ear canal for achieving various advantages including reduction of the acoustic occlusion effect, improved energy efficiency, reduced distortion, reduced receiver (speaker) vibrations, and improved high frequency response. Another well-known advantage of ear canal placement is aesthetics as many hearing-impaired individuals refuse to wear visible hearing devices such as in-the-ear (ITE) or behind-the-ear (BTE) types. FIG. 1 shows typical placement of a conventional CIC device 20 inside the ear canal 10 with handle 21 extending substantially outside of the aperture 11. FIG. 2 shows conventional deep canal hearing device 40 placement, where the deep canal hearing device includes a removal handle 41, which is located inside the ear canal 10 substantially medially relative to the aperture 11. Canal hearing devices are generally fitted and inserted, at least initially, by hearing professionals due to the sensitivity of the ear canal in the bony region 13 and the proximity to the eardrum 15. Improper insertion of a canal hearing device can lead to trauma and serious damage.

SUMMARY

The present disclosure describes systems and methods of handheld tools to facilitate inserting a canal hearing device into the ear canal. An example tool for manually inserting a canal hearing device into the ear canal includes medial section configured to removably couple to a lateral end of the canal hearing device, the medial section including a first cavity for cradling at least a portion of the lateral end of the canal hearing device and a second cavity for engaging a knob element attached with a shaft to the lateral end of the canal hearing device. The tool further includes a handle section laterally positioned and structured to manually release the knob element, wherein the tool is configured to secure the canal hearing device to the tool by retaining the knob element within the second cavity and cradling the lateral end of the canal hearing device within the first cavity.

According to some examples, a tool for inserting a canal hearing device into the ear canal includes a monolithic tool body which includes a medial section having a first cavity and a second cavity positioned laterally relative to the first cavity, the first cavity and the second cavity being connected by a first channel, the tool body further including a handle section extending lateral to the medial section and configured to be resiliently deformed from a first position to a second position upon the application of a force and wherein the handle section returns to the first position upon release of said force, wherein the handle section is coupled to the medial section such that deformation of the handle section changes a dimension of the first and second cavities.

Examples of methods for inserting a canal hearing device into the ear canal are described. According to one example, the method includes engaging a medial end of an insertion tool with a canal hearing device outside of the ear canal by axially joining the insertion tool to a lateral end of the canal hearing device, whereby a knob element of the canal hearing device is constrained within a locking cavity of the medial end and a portion of the lateral end of the canal hearing device is cradled within a cradling cavity of the medial end, grasping a handle of the insertion tool, and inserting the canal hearing device into the ear canal by advancing the medial end of the insertion tool with the canal hearing device engaged therewithin towards the ear canal t while the insertion tool is cradling the lateral end and constraining the knob element.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Figure 1:
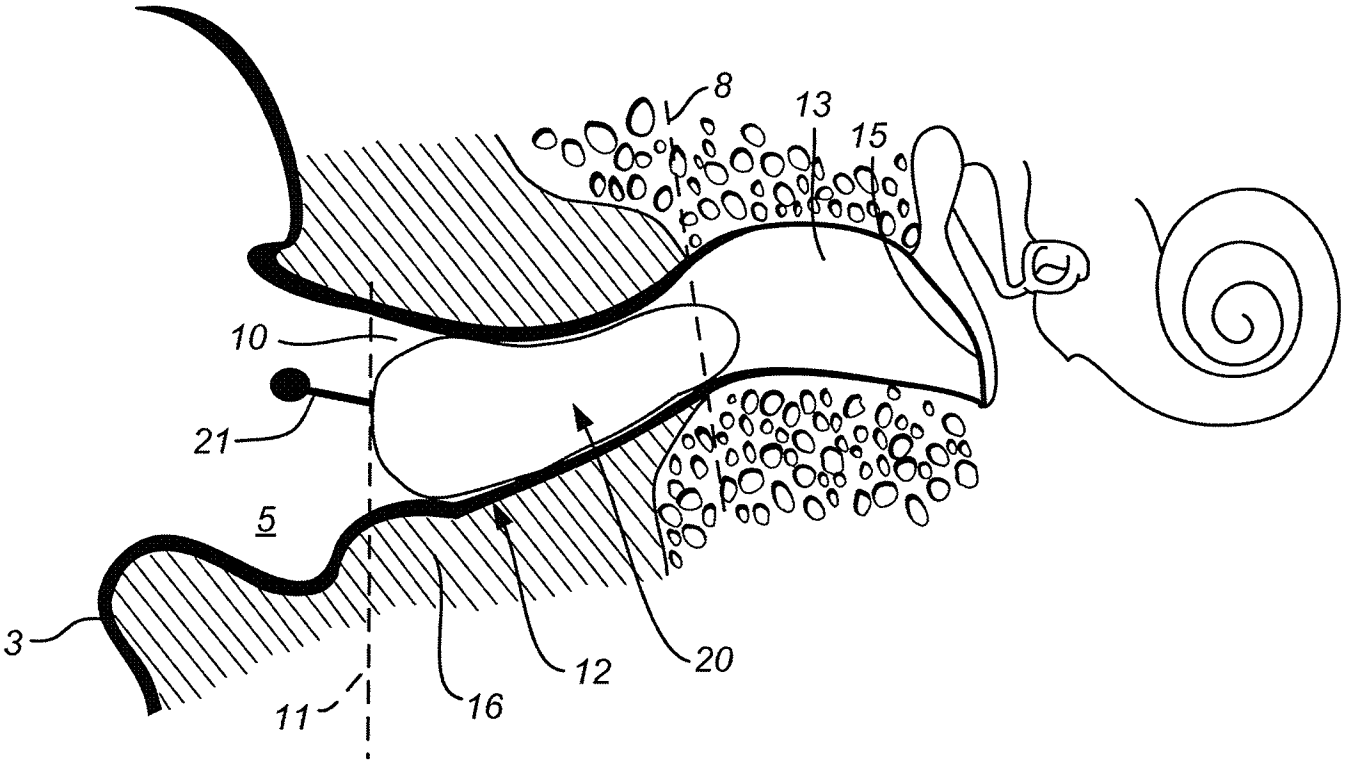
FIG. 1 is a view of the ear canal showing regions of the ear canal and placement of a canal hearing device.
Figure 2:
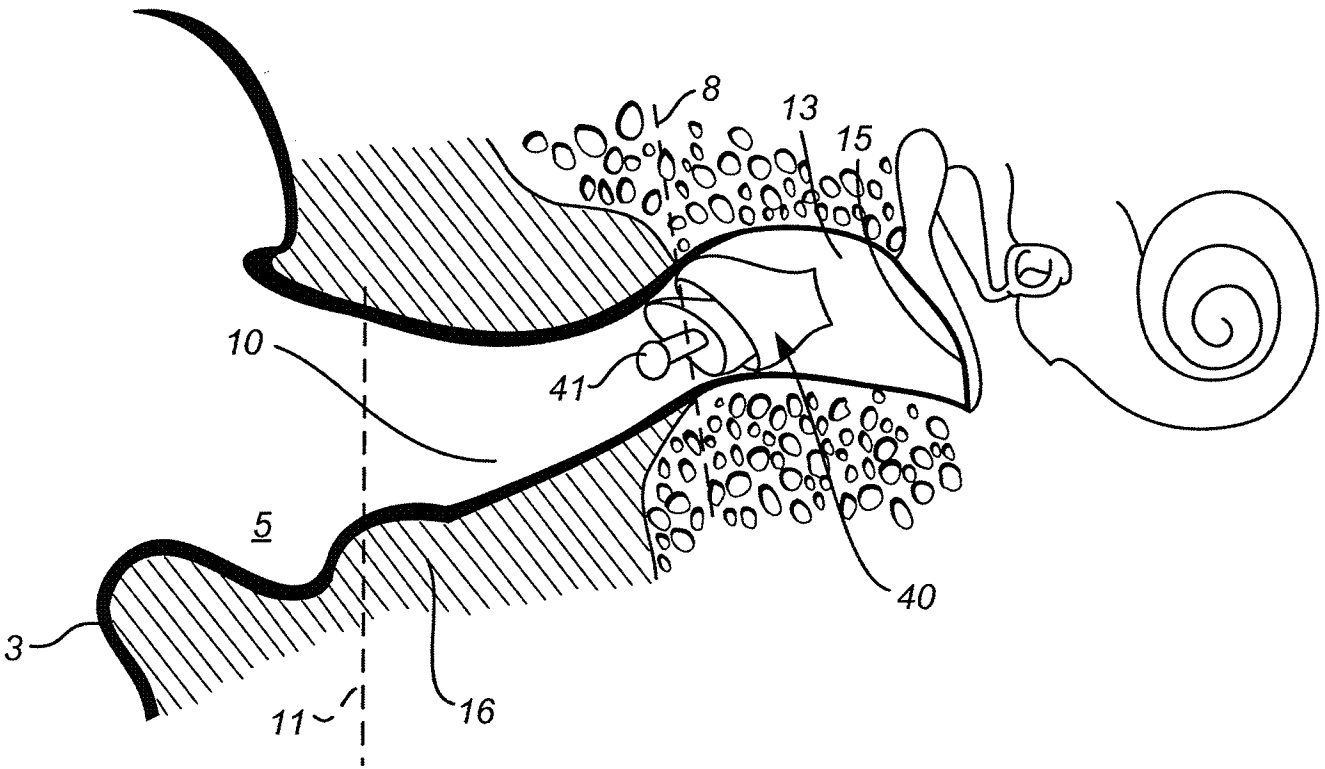
FIG. 2 is a view of the ear canal showing placement of a conventional deep canal hearing device.

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

Examples of methods and tools for inserting and removing canal hearing devices into and out of the ear canal are described. A tool for inserting a canal hearing device according to the present disclosure includes a clamping section and a handle section. The clamping section is located at the medial end of the tool body and configured to be removably coupled to a lateral end of the canal hearing device. The handle section may be located laterally to the clamping section (e.g. at a lateral end of the tool body) and may be adapted for engaging or disengaging the canal hearing device from the tool and/or manipulating the canal hearing device into the ear canal. The clamping section includes a first cavity and a second cavity positioned laterally to the first cavity. The first and second cavities are connected by a channel. The handle section may include structures for gripping the tool and manipulating the tool to engage with the canal hearing device.

In some examples, the tool body may be formed as a monolithic structure, for example to minimize costs and simplify production of the tool. The tool body may be generally symmetric about its longitudinal axis thereby defining a first half and a second half. The first half and the second half may be attached to one another by a pivot portion, also integral with the monolithic tool body. The pivot portion may be located centrally at an intermediate location between the medial and lateral ends of the tool body. In other examples, the pivot portion may be located at the lateral end of the tool body. Other configurations and relative arrangements of the components of the tool body may also be used without departure from the present scope. Regardless of location of the pivot portion, the tool is configured to deform resiliently from a first position to a second position upon the application of a force and to return to the first position upon releasing of said force. Particular examples of tools and methods according to the present disclosure will now be described in further detail with reference to FIGS. 3-9.

Examples of tools and methods of use of handheld tools for safely inserting a canal hearing device 20 into the ear canal 10 are described herein with reference to FIGS. 3-9. An example system includes a handheld insertion tool 30 with a locking cavity 31 for capturing a low-profile knob element 24 incorporated within the canal hearing device 20. The insertion tool 30 includes a medial (e.g. distal) section 32 which may be shaped for a cooperating fit with the lateral end 22 of the canal hearing device 20. In this regard, the medial section 32 may be configured to mate with the lateral end 22 of the canal hearing device 20 by constraining or grasping the knob element in combination with cradling at least a portion of the lateral end 22 of the canal hearing device 20, as will be further described.

The lateral section 35 of the insertion tool 30 may be configured to include a handle structured for manually releasing the knob element 24 of the canal hearing device 20. According to some methods of use of the tool 30, the knob element 24 is engaged with the insertion tool 30 by the user outside of the ear canal (FIGS. 3 & 4) prior to insertion of the canal hearing device 20 into the ear canal 10 as shown in FIG. 5.

The elements of the insertion tool 30 may be formed of a monolithic structure to minimize cost and manufacturing complexity and to improve the reliability of the tool. In some examples, the monolithic structure may be molded of plastic material, such as PEEK. Materials other than PEEK may also be used. In these examples, the tool may be 0.6-1.5 inches long to allow for close proximity to and to facilitate short distance leveraging with respect to the canal hearing device 20, for example, for ease of navigating the canal hearing device 20 through the contours of the ear. In the depicted embodiments, the medial section 32 of the insertion tool 30 is designed and sized to cradle the lateral end 22 or a portion thereof of the canal hearing device 20. The lateral end 22 of the canal hearing device 20 may be generally in the shape of a removable battery module 23, as disclosed in related patent applications Ser. Nos. 12/878,926 and 13/424,242, incorporated herein in their entirety for any purpose. The handle section 35 of the insertion tool 30 may be sized to be comfortably grasped by a user's fingers for engaging the canal hearing device 20 and manipulating it into the ear canal 10 (FIG. 5), and for releasing it after placement inside the ear canal 10 (FIG. 6).

In one embodiment, as shown in FIGS. 3-6, the insertion tool 30 is configured with a central pivot 33 structure between the handle section 35 and the medial section 32. In other embodiments, for example as shown in FIGS. 7 & 8, the insertion tool 30 is configured with a lateral pivot 37 structure, lateral to the handle section 48. In some embodiments, the tool may include a label, for example on the top section 38 (FIG. 3) and/or bottom section 39, to designate orientation. Certain embodiments may be configured to either engage with a right or a left canal hearing device 20, and/or to insert the canal hearing device in the left or right ear. In such examples, the labeling may facilitate proper positioning and use of the tool with the designated canal hearing device and in the designated ear.

In the embodiment shown in FIGS. 3-9, the tool body may be generally symmetric about the longitudinal axis of the tool 30 and may include a first half 38 and a second half 39. The first and second halves 38 and 39 may be joined at the central pivot 33 and may remain separated by a lateral channel 45 and a medial channel 46. In some examples, the first half 38 and the second half 39 are generally mirrored halves. In some examples, the medial channel 46 may be configured to allow the knob element 24 and shaft element 25 of the canal hearing device 20 to pass through at least a portion of the medial channel 46 until the knob element 24 engages with the knob locking cavity 31. In some examples, the insertion tool 30 may be further symmetrically designed for universal mating with the lateral end 22 of a right or a left canal hearing device 20, and in either of the two opposing 180° degree orientations. In such examples, the engagement orientation of the insertion tool 30 may be reversible with respect to the canal hearing device and the insertion tool 30 may be used interchangeably with either a left or a right canal hearing device 20.

Figure 3:
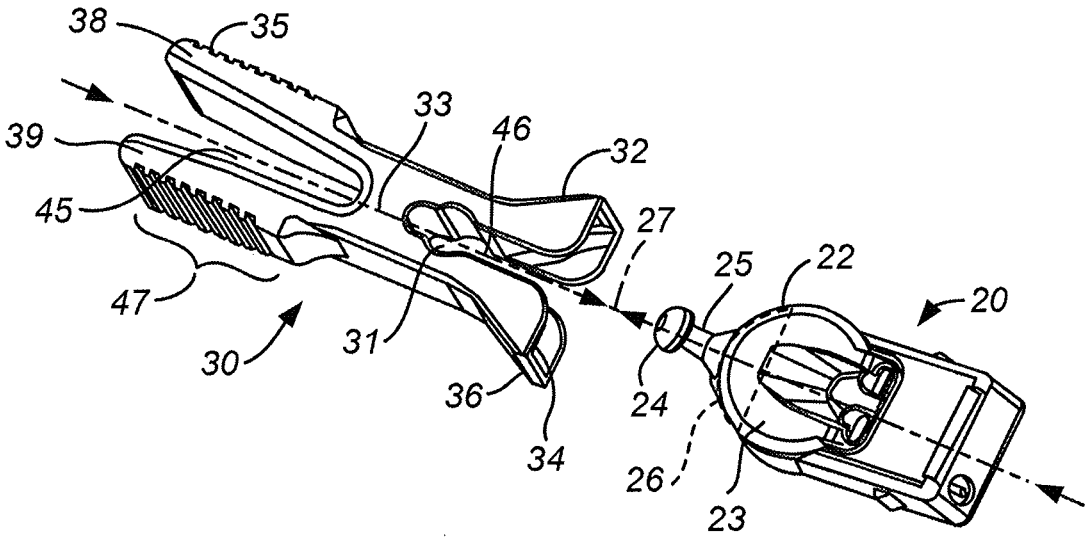
FIG. 3 is a view of an example embodiment of an insertion tool according to the present disclosure.
Figure 4:
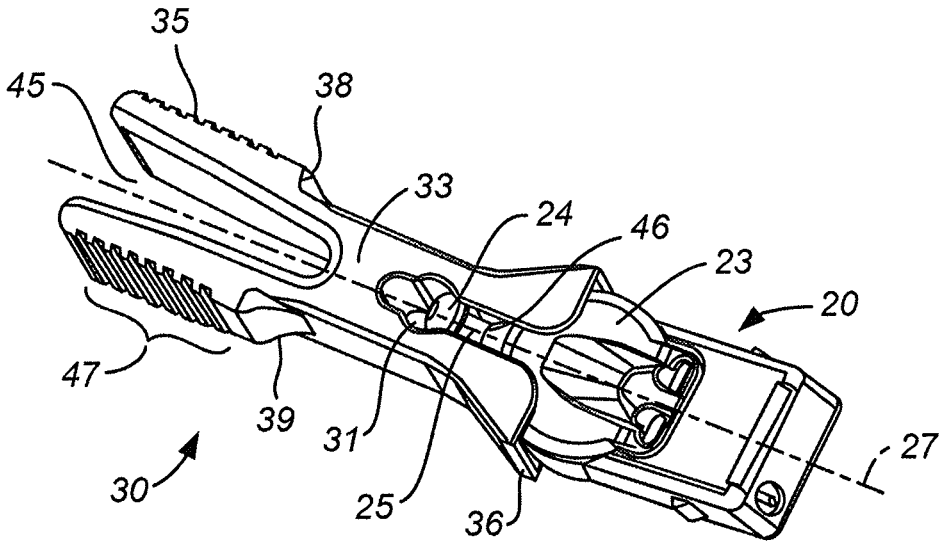
FIG. 4 is a view of the example embodiment of FIG. 3 depicting the insertion tool engaged with the canal hearing device.
Figure 5:
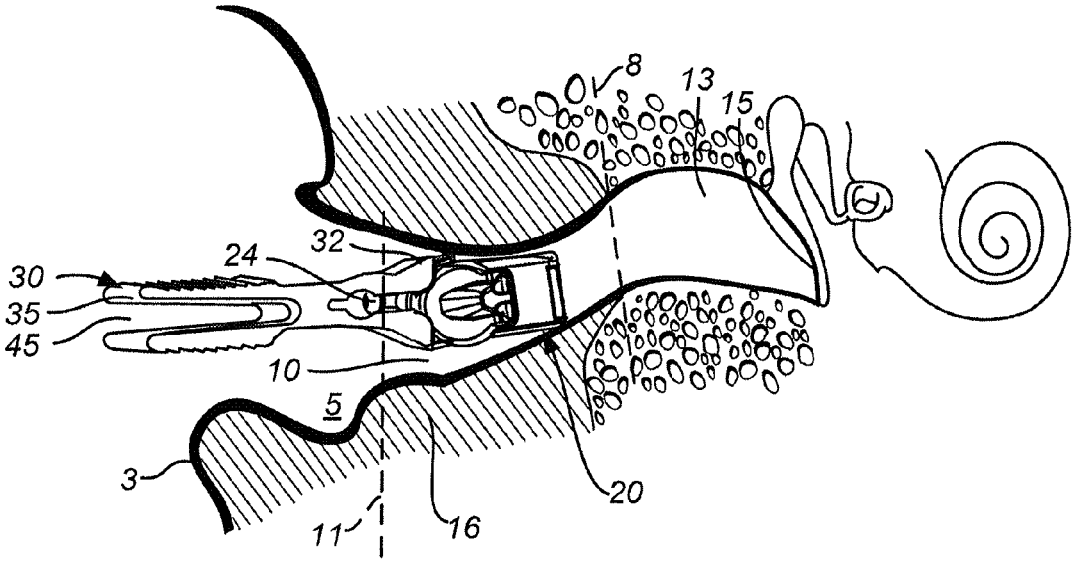
FIG. 5 is a view of the example embodiment of FIG. 3 depicting the insertion tool engaged with the canal hearing device during insertion of the canal hearing device into the ear canal.
Figure 6:
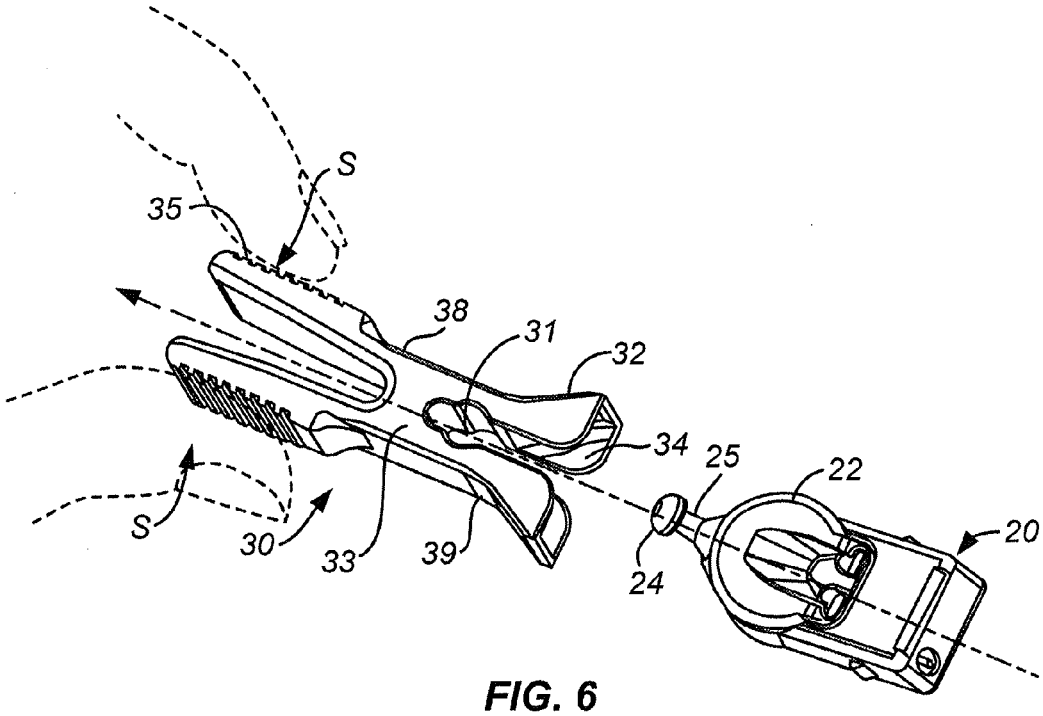
FIG. 6 is a view of the example embodiment of FIG. 3 showing the disengagement by squeezing the handle section and axially separating the insertion tool from the canal hearing device.
Figure 7:
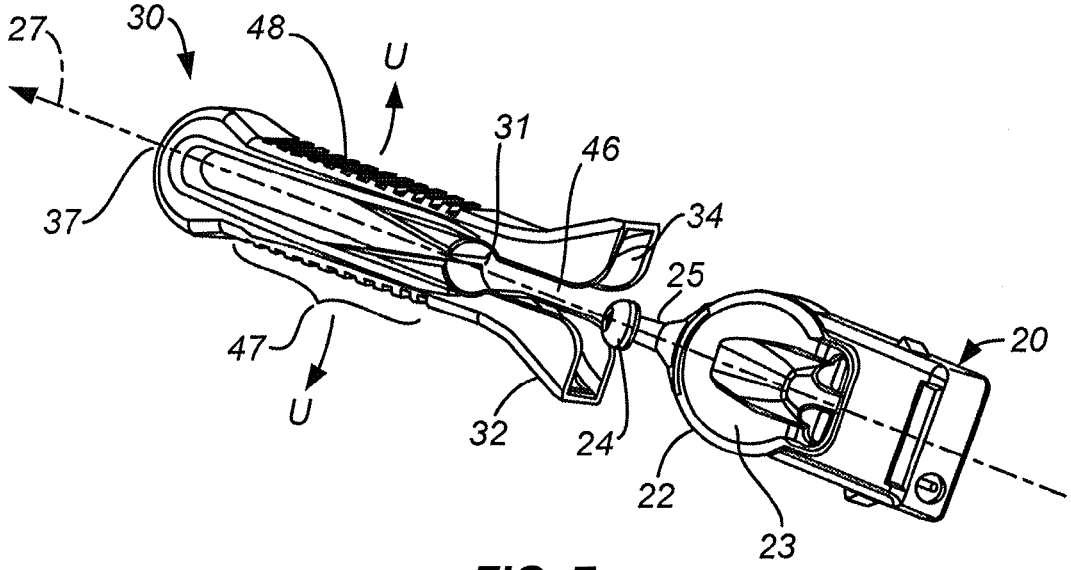
FIG. 7 is a view of an alternate example embodiment of the present invention showing a canal hearing device prior to engagement, in which engagement requires squeezing the handle section of the insertion tool and disengaging requires unsqueezing the handle section.
Figure 8:
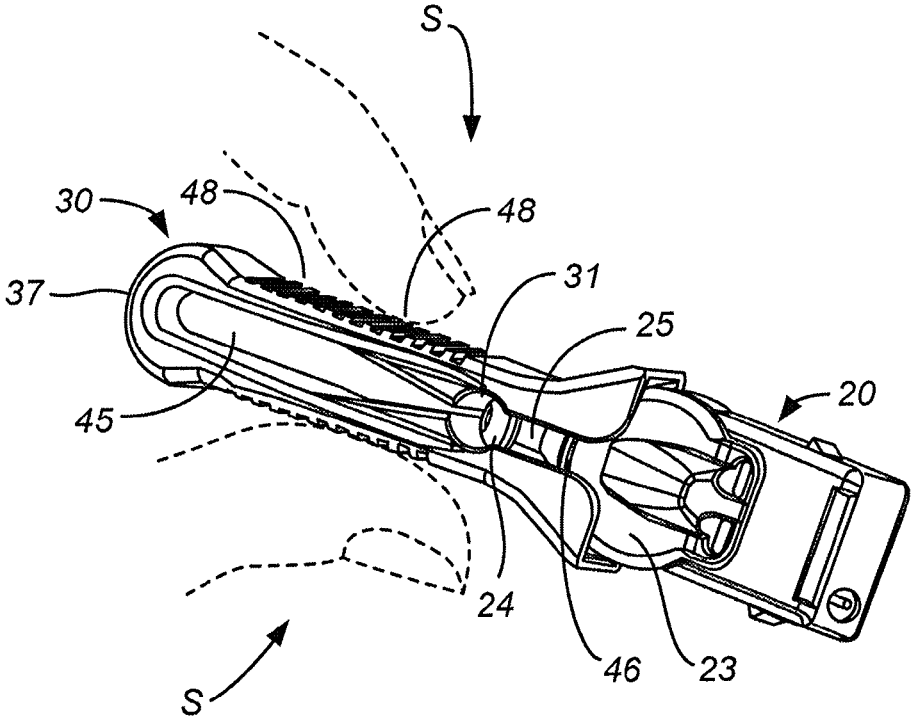
FIG. 8 is a view of the alternate example embodiment of FIG. 7 shown engaged by squeezing the handle section of the insertion tool.
Figure 9:
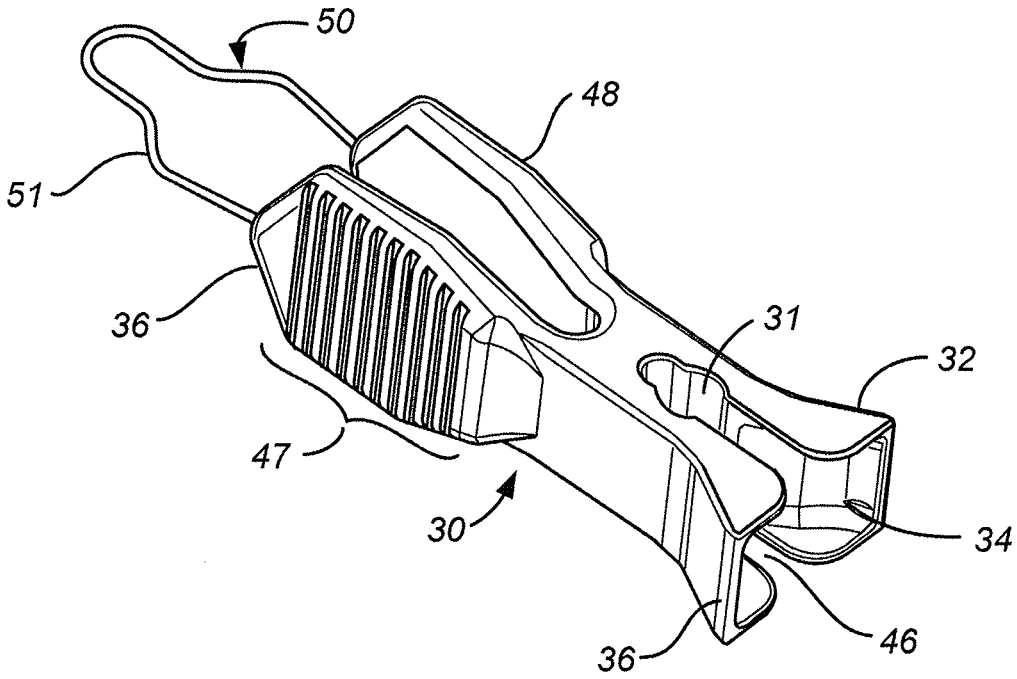
FIG. 9 is a view of an alternate example of the insertion tool incorporating a removal loop for removing a canal hearing device from the ear canal after insertion and use therein.

In the embodiments in FIGS. 3-9, the medial section 32 of the insertion tool 30 includes a knob locking cavity 31 sized and shaped for clamping the knob element 24 laterally positioned on the canal hearing device 20 and connected thereto by a shaft element 25 (e.g., as shown in FIGS. 4 & 7). According to the examples herein, the knob locking cavity 31 may be sized to accommodate the knob element 24 therein. The opening to the cavity 31 may be increased by flexing or squeezing the handle section 35 as will be further described or by snap fitting the knob element 24 through the clamping section.

The insertion tool 30 may be configured for positioning the knob element 24 generally at the aperture vicinity 11 (FIG. 5) of the ear canal 10, including within the concha cavity 5 region for manual access during self removal of the canal hearing device. The medial section 32 of the tool further includes a cradling cavity 34 for cradling the lateral end 22 of the canal hearing device 20 while being inserted into the ear canal 10. For example, the cradling cavity 34 may have a complementary shape to the generally curved shape of the battery module 23 at the lateral end 22. In the present example, the canal hearing device 20 is generally secured to the insertion tool 30 by simultaneously locking the knob element 24 and cradling the lateral end 22 of the canal hearing device 20. In some examples, the insertion tool may further include flanges 36 at the medial section 32 which may be configured to prevent unsafe advancement of the knob element 24 beyond the aperture 11 region of the ear canal 10. For example, the width of the insertion tool at the flanges may be equal to or be greater than the width of the ear canal at the aperture 11. In some examples, the flanges may be configured such that the tool may be inserted past the aperture. The edges of the flanges may be rounded to prevent injury to the ear canal or other features or softer materials may be incorporated to minimize risk of injury should the insertion tool contact walls of the ear canal.

In the depicted embodiments, the cradling cavity 34 is configured for self-centering with respect to the lateral end 22 of the canal hearing device 20 when mating thereto. Self-centering provides an automatic alignment mechanism for users, particularly the hearing impaired with limited vision or manual dexterity. In the preferred embodiments, the cradling cavity 34 is generally C-shaped as shown in FIGS. 3-9 for mating with a complimentary D-shaped section 26 (FIG. 3) of the canal hearing device 20.

In the embodiment shown in FIGS. 3-6, the knob locking cavity 31 of the insertion tool 30 is configured to lock the knob element 24 of the canal hearing device 20 within by means of a snap fit mechanism generally performed by axial alignment along the elongate axis 27 as shown in FIGS. 3 & 4. Snap fit of the insertion tool 30 with respect to the lateral end 22 of the canal hearing device allows for engagement therebetween without resorting to squeezing or otherwise manipulating the handle section 35 to expand the medial section 32 of the insertion tool 30.

In the embodiments depicted in FIGS. 3-6, the handle section 35 is configured for manually releasing the knob element 24 by pressing or squeezing the handle section 35 as shown by arrows "S" in FIG. 6. Upon the application of the force as a result of the squeezing in the direction S may cause the first and second halves 38, 39 to "pivot" about the pivot portion 33 to expand the cavities 31 and 34 in the medial section 32 and allowing the knob element 24 to be released. In other examples, the mechanism of deforming the insertion tool from a first position to a second position (e.g. to "open" and/or "close" the tool), may be reversed based on the location of the pivot portion. For example, in instances where a lateral pivot 37 is used, the application of a squeezing force causes the tool to "close" thereby grasping the canal hearing device 20 via the knob element 24, and releasing of the squeezing force releases the knob element 24 from the medial section 32, as will be further described.

The handle section 35 may incorporate grooves 47 or other suitable structures to facilitate grasping of the handle section by a user's fingers. As discussed above, in embodiment shown in FIGS. 7 & 8, the relative position of the handle section and pivot portion are switched, thus the pivot portion may be referred to as lateral portion and the handle section may be referred to as central handle section. The mechanism for engaging the knob element 24 is also reversed and the knob element may be engaged by squeezing a central handle section 48 after axial alignment. As with the previous example, the lateral end 22 of the canal hearing device 20 (FIG. 8) may be simultaneously engaged within the clamping section of the insertion tool. In this embodiment, disengagement of the canal hearing device 20 from the insertion tool 30 occurs by the user releasing the handle (as indicated by the arrows "U") and subsequently removing the insertion tool 30 away from the canal hearing device 20 as shown in FIG. 7. As will be understood, the lateral pivot 37 may be configured to be sufficiently resilient to apply a spring force upon the releasing of the squeezing force on the handle. In this example, the handle section may be configured to resiliently deform from an open to a closed position upon the application of a force by the user, the handle section being further configured to return to the open position upon removal of the applied force.

In some examples, the insertion tool 30 may be a part of a multi-purpose tool kit (not shown) for operating and manipulating the canal hearing device 20. In yet another embodiment shown in FIG. 9, the lateral end 36 of the insertion tool 30 may further include a removal loop 50 for removing the canal hearing device 20 from the ear canal 10. An example of a removal loop may be implemented according to the disclosure of U.S. patent application Ser. No. 13/461,327, incorporated herein in its entirety for any purpose. The removal loop 50 may be made of thin metal wire 51 shaped to engage with and hold the knob element 24. Such a design may be advantageous to minimize interference with the ear at the concha region 5 or the aperture region 11 during the removal of the canal hearing device 20 from the ear canal. The diameter of the loop wire 51 may be less than approximately 0.25 mm. The integration of these tools in this manner may offers insertion and removal capabilities combined in a unitary hand-held design. The shape and dimensions of the removal loop 50, with respect to the knob element 24, may allow for self-centering within the aperture area 11 or concha region 5 for "blind" engagement and interlocking with the knob element 24. The removal loop 50 is preferably made of a single formed wire to maximize durability, minimize interference volume, minimize cost of fabrication, and provide safe contact with the walls of the ear by virtue of closed loop contoured design, as an example. Other advantages may be achieved and appreciated in light of this disclosure. After capturing the knob element 24 and removing the device 20 from the ear canal 10, the removal loop 50 can readily be disengaged from the hearing device 20 upon pulling the knob element 24 towards the relatively wide section of the removal loop 50, said wide section being sized to allow the knob element to freely pass therethrough, as further described in U.S. patent application Ser. No. 13/461,327.

The design and features of the present invention as described above may be particularly suited for hearing impaired individuals, who may find it difficult to manipulate and insert a highly miniaturized canal hearing device into the ear canal. This may be due to limited dexterity, poor vision, or poor visualization of ear canal contours. The insertion tool also allows for operation in conjunction with a canal hearing device having a low profile handle, thus making it particularly inconspicuous. For example, by providing a canal hearing device with a 4.5 mm long handle, instead of normally 7 mm or longer as frequently used in conventional canal hearing devices. The shaft of canal hearing device in the examples according to the present disclosure may be substantially elongated with a diameter substantially less than the length of the shaft, with dimensions selected to ensure sufficient clearance for locking the knob element within the locking cavity of the insertion tool.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A tool for manually inserting a canal hearing device into the ear canal comprising:

a medial section configured to removably couple to a lateral end of the canal hearing device, the medial section including a first cavity for cradling at least a portion of the lateral end of the canal hearing device and a second cavity for constraining a knob element attached to the lateral end of the canal hearing device; and a handle section laterally positioned and structured to manually release the knob element, wherein the tool is configured to secure the canal hearing device to the tool by constraining the knob element within the second cavity and cradling the lateral end of the canal hearing device within the first cavity.

2. The tool of claim 1, wherein the tool is a monolithic structure.

3. The tool of claim 1, wherein the first cavity is configured for self-centering with the lateral end of the canal hearing device when mating thereto.

4. The tool of claim 1, wherein the second cavity is configured to constrain the knob element therewithin by a snap fit between the knob element and the second cavity.

5. The tool of claim 4, wherein the snap fit is achieved without expansion of the medial section of the tool.

6. The tool of claim 1, wherein the second cavity is configured to constrain the knob element therewithin in response to an application of a squeezing force on the handle section.

7. The tool of claim 1, wherein the tool is symmetrically designed for mating with the lateral end of the canal hearing device in either of two opposing orientations.

8. The tool of claim 1, wherein the first cavity is C-shaped for mating with a complimentary D-shaped section of the lateral end of the canal hearing device.

9. The tool of claim 1, further comprising a central pivoting structure positioned between the handle section and medial section.

10. The tool of claim 9, further comprising a medial channel extending from a medial end of the tool towards the central pivoting structure and a lateral channel extending from a lateral end of the tool towards the central pivoting structure.

11. The tool of claim 10, wherein sections of the tool on opposing sides of the medial channel and lateral channel are generally mirrored halves.

12. The tool of claim 1, further comprising a channel between the first cavity and the second cavity to allow the knob element to advance to the second cavity.

13. The tool of claim 1, wherein the tool is configured to manually release the knob element by squeezing the handle section.

14. The tool of claim 1, wherein the tool is configured to engage the knob element by squeezing the handle section and further configured to manually release the knob element by unsqueezing the handle section.

15. The tool of claim 1, wherein the medial section further comprises one or more structures extending from the medial section configured to prevent advancement of the knob element beyond the aperture of the ear canal.

16. The tool of claim 15, wherein the one or more structures extending from the medial section include a flange.

17. The tool of claim 1, wherein the tool further comprises a pivoting structure lateral to the handle section.

18. The tool of claim 1, further comprising a removal loop attached to a lateral end and configured for interlocking with the knob element of the canal hearing device while the canal hearing device is in the ear canal.

19. A tool for inserting a canal hearing device into the ear canal, the tool comprising:

a medial section having a first cavity and a second cavity positioned laterally relative to the first cavity; and a handle section extending lateral to the medial section and configured to be squeezed from a first position to a second position upon the application of a force and wherein the handle section returns to the first position upon release of said force;

wherein the handle section is coupled to the medial section such that squeezing of the handle section changes a dimension of the first and second cavities.

20. The tool of claim 19 wherein the tool further includes a pivot portion.

21. The tool of claim 20, wherein the pivot portion is located between the medial section and the handle section.

22. The tool of claim 20, wherein the pivot portion is located laterally relative to the handle section.

23. The tool of claim 19, wherein the first position is a closed position and the second position is an open position.

24. The tool of claim 19, wherein the first cavity is smaller than the second cavity and the second cavity is shaped cooperating to the shape of a battery module of the canal hearing device.

25. A method for inserting a canal hearing device into the ear canal, the method comprising:

engaging a medial section of an insertion tool with a canal hearing device outside of the ear canal by axially joining the insertion tool to a lateral end of the canal hearing device, wherein the insertion tool comprises:

the medial section, the medial section configured to removably couple to the lateral end of the canal hearing device, the medial section including a first cavity for cradling at least a portion of the lateral end of the canal hearing device and a second cavity for constraining a knob element attached to the lateral end of the canal hearing device; and a handle section laterally positioned and structured to manually release the knob element, wherein the tool is configured to secure the canal hearing device to the tool by constraining the knob element within the second cavity and cradling the lateral end of the canal hearing device within the first cavity;

and inserting the canal hearing device into the ear canal by advancing the medial section of the insertion tool with the canal hearing device engaged therewithin towards the ear canal while the insertion tool is cradling the lateral end and constraining the knob element.

26. The method of claim 25, further comprising releasing the canal hearing device from the insertion tool by pressing the lateral end of insertion tool.

27. The method of claim 25, further comprising releasing the canal hearing device from the insertion tool by unsqueezing the lateral end of insertion tool.

28. The method of claim 25, further comprising preventing advancement of the knob element beyond the aperture of the ear canal.

29. The method of claim 25, wherein said axially joining comprises snap fitting the insertion tool to the lateral end of the canal hearing device.

30. The method of claim 25, further comprising:

disengaging the insertion tool from the canal hearing device by manually manipulating the handle of the insertion tool.

31. The method of claim 25, wherein said axially joining the insertion tool to the lateral end of the canal hearing device includes squeezing the handle of the insertion tool.

32. The method of claim 25, further comprising using a removal loop attached to a lateral end of the insertion tool to remove the canal hearing device from the ear canal.

33. The method of claim 30, wherein said disengaging the insertion tool includes squeezing the handle of the insertion tool.

34. The method of claim 30, wherein said disengaging the insertion tool includes unsqueezing the handle of the insertion tool.

* * * * *